US006003212A

United States Patent [19]

Imahata

[11] Patent Number: 6,003,212

[45] Date of Patent: Dec. 21, 1999

[54] PAIR OF SHOES FASTENER

[76] Inventor: Takeo Imahata, 7390 Woodsboro Ave., Anaheim, Calif. 92807

[21] Appl. No.: 09/238,903

[22] Filed: Jan. 28, 1999

[51] Int. Cl.[6] ..... A43C 11/00; A43B 3/00

[52] U.S. Cl. ..... 24/578; 24/324; 24/662; 24/DIG. 29; 36/1

[58] Field of Search ..... 24/578, 557, 575, 24/324, 662, DIG. 29; 36/1

[56] References Cited

U.S. PATENT DOCUMENTS

| | | | |
|---|---|---|---|
| 505,734 | 9/1893 | Umstead | 24/DIG. 29 |
| 902,573 | 11/1908 | Fleck | 36/1 |
| 2,761,223 | 9/1956 | Legeai | 36/1 |
| 2,857,688 | 10/1958 | Haase | 24/578 |
| 3,000,067 | 9/1961 | Hanflig | 36/1 |
| 3,041,743 | 7/1962 | Monsma | 36/1 |
| 3,482,335 | 12/1969 | Ornsteen | 36/1 |
| 3,734,551 | 5/1973 | Hughes et al. | 24/662 |
| 4,624,060 | 11/1986 | Maxwell | 36/1 |
| 5,269,690 | 12/1993 | Zigon | 36/1 |

FOREIGN PATENT DOCUMENTS

| | | | |
|---|---|---|---|
| 0016365 | of 1911 | United Kingdom | 24/662 |
| 1107759 | 3/1968 | United Kingdom | 24/662 |

*Primary Examiner*—Victor N. Sakran

[57] ABSTRACT

A pair of shoes fastener for releasably coupling at least one pair of shoes together. The pair of shoes fastener includes a male portion and a female portion that are releasably coupleable together. The male portion has a neck member outwardly extending from the front face thereof and a bulbous end portion extending from the neck member. The female portion has an aperture extending through its top and bottom faces and a pair of axial breaks providing an opening through the front face of the female portion into the aperture. The aperture and the axial breaks define a groove of the female portion. The end and neck members of the male portion are slidably insertable in the groove of the female portion. The male portion is coupled to an inner side of a shoe. The female portion is coupled to an inner side of another shoe.

13 Claims, 2 Drawing Sheets

PAIR OF SHOES FASTENER

BACKGROUND OF THE INVENTION

1. Field of the Invention

The present invention relates to footwear attachments and more particularly pertains to a new pair of shoes fastener for releasably coupling at least one pair of shoes together.

2. Description of the Prior Art

The use of footwear attachments is known in the prior art. More specifically, footwear attachments heretofore devised and utilized are known to consist basically of familiar, expected and obvious structural configurations, notwithstanding the myriad designs encompassed by the crowded prior art which have been developed for the fulfillment of countless objectives and requirements.

Known prior art includes U.S. Pat. No. 3,041,743; U.S. Pat. No. 2,761,223; U.S. Pat. No. 2,266,281; U.S. Pat. No. 5,269,690; U.S. Pat. No. 3,000,067; and U.S. Pat. No. Des. 273,659.

While these devices fulfill their respective, particular objectives and requirements, the aforementioned patents do not disclose a new pair of shoes fastener. The inventive device includes a male portion and a female portion that are releasably coupleable together. The male portion has a neck member outwardly extending from the front face thereof and a bulbous end portion extending from the neck member. The female portion has an aperture extending through its top and bottom faces and a pair of axial breaks providing an opening through the front face of the female portion into the aperture. The aperture and the axial breaks define a groove of the female portion. The end and neck members of the male portion are slidably insertable in the groove of the female portion. The male portion is coupled to an inner side of a shoe. The female portion is coupled to an inner side of another shoe.

In these respects, the pair of shoes fastener according to the present invention substantially departs from the conventional concepts and designs of the prior art, and in so doing provides an apparatus primarily developed for the purpose of releasably coupling at least one pair of shoes together.

SUMMARY OF THE INVENTION

In view of the foregoing disadvantages inherent in the known types of footwear attachments now present in the prior art, the present invention provides a new pair of shoes fastener construction wherein the same can be utilized for releasably coupling at least one pair of shoes together.

The general purpose of the present invention, which will be described subsequently in greater detail, is to provide a new pair of shoes fastener apparatus and method which has many of the advantages of the footwear attachments mentioned heretofore and many novel features that result in a new pair of shoes fastener which is not anticipated, rendered obvious, suggested, or even implied by any of the prior art footwear attachments, either alone or in any combination thereof.

To attain this, the present invention generally comprises a male portion and a female portion that are releasably coupleable together. The male portion has a neck member outwardly extending from the front face thereof and a bulbous end portion extending from the neck member. The female portion has an aperture extending through its top and bottom faces and a pair of axial breaks providing an opening through the front face of the female portion into the aperture. The aperture and the axial breaks define a groove of the female portion. The end and neck members of the male portion are slidably insertable in the groove of the female portion. The male portion is coupled to an inner side of a shoe. The female portion is coupled to an inner side of another shoe.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new pair of shoes fastener apparatus and method which has many of the advantages of the footwear attachments mentioned heretofore and many novel features that result in a new pair of shoes fastener which is not anticipated, rendered obvious, suggested, or even implied by any of the prior art footwear attachments, either alone or in any combination thereof.

It is another object of the present invention to provide a new pair of shoes fastener which may be easily and efficiently manufactured and marketed.

It is a further object of the present invention to provide a new pair of shoes fastener which is of a durable and reliable construction.

An even further object of the present invention is to provide a new pair of shoes fastener which is susceptible of a low cost of manufacture with regard to both materials and labor, and which accordingly is then susceptible of low prices of sale to the consuming public, thereby making such pair of shoes fastener economically available to the buying public.

Still yet another object of the present invention is to provide a new pair of shoes fastener which provides in the apparatuses and methods of the prior art some of the advantages thereof, while simultaneously overcoming some of the disadvantages normally associated therewith.

Still another object of the present invention is to provide a new pair of shoes fastener for releasably coupling at least one pair of shoes together.

Yet another object of the present invention is to provide a new pair of shoes fastener which includes a male portion and a female portion that are releasably coupleable together. The male portion has a neck member outwardly extending from the front face thereof and a bulbous end portion extending from the neck member. The female portion has an aperture extending through its top and bottom faces and a pair of axial breaks providing an opening through the front face of the female portion into the aperture. The aperture and the axial breaks define a groove of the female portion. The end and neck members of the male portion are slidably insertable in the groove of the female portion. The male portion is coupled to an inner side of a shoe. The female portion is coupled to an inner side of another shoe.

Still yet another object of the present invention is to provide a new pair of shoes fastener that helps keep shoes organized by permitting several shoes to be coupled together.

Even still another object of the present invention is to provide a new pair of shoes fastener that holds shoes together when exercising.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
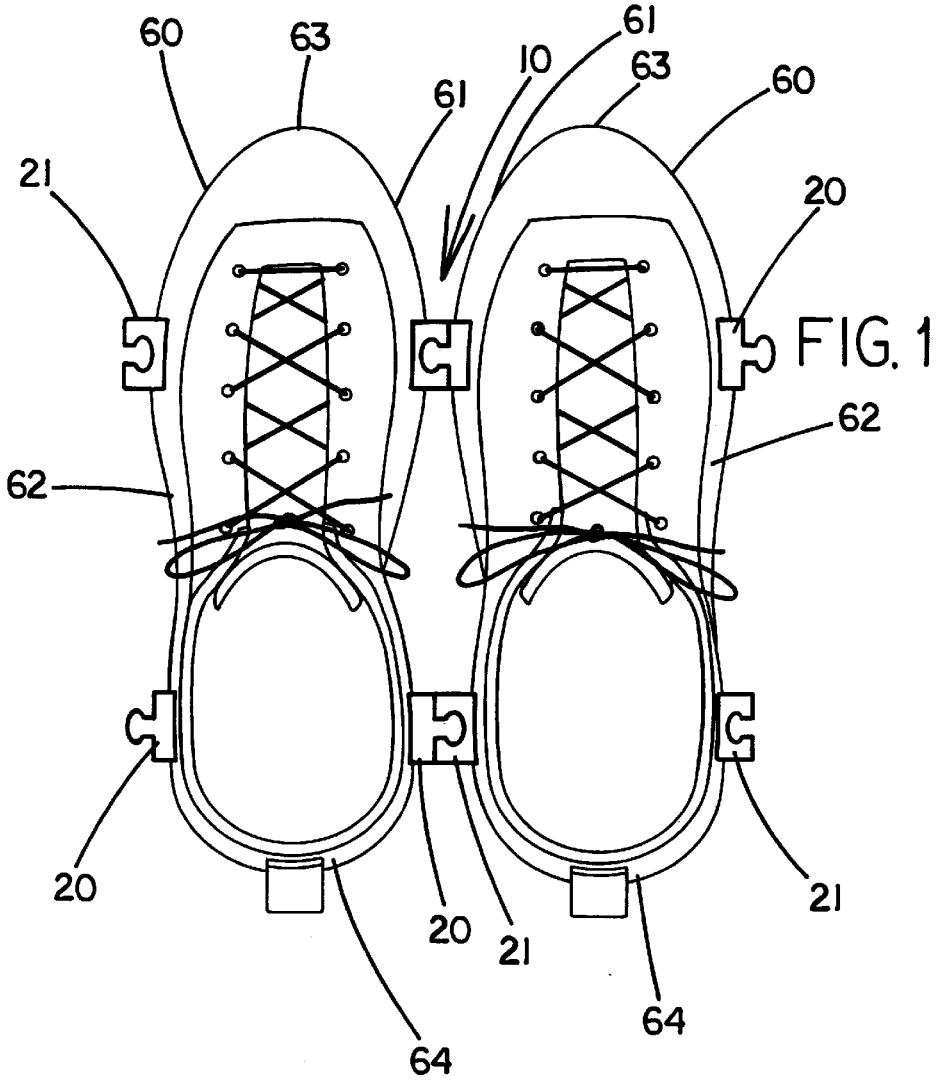
FIG. 1 is a schematic top view of a new pair of shoes fastener according to the present invention.
Figure 2:
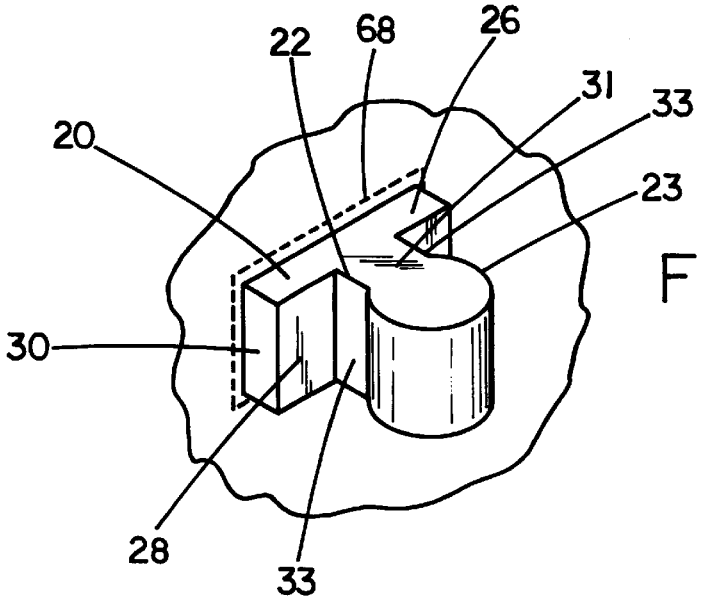
FIG. 2 is a schematic perspective view of a male fastener of the present invention.
Figure 3:
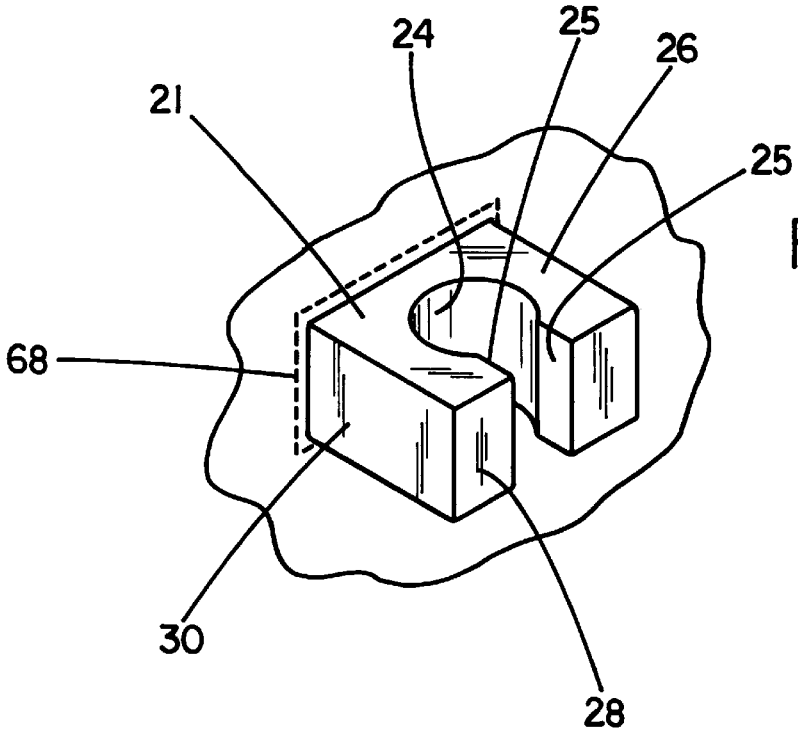
FIG. 3 is a schematic perspective view of a female fastener of the present invention.
Figure 4:
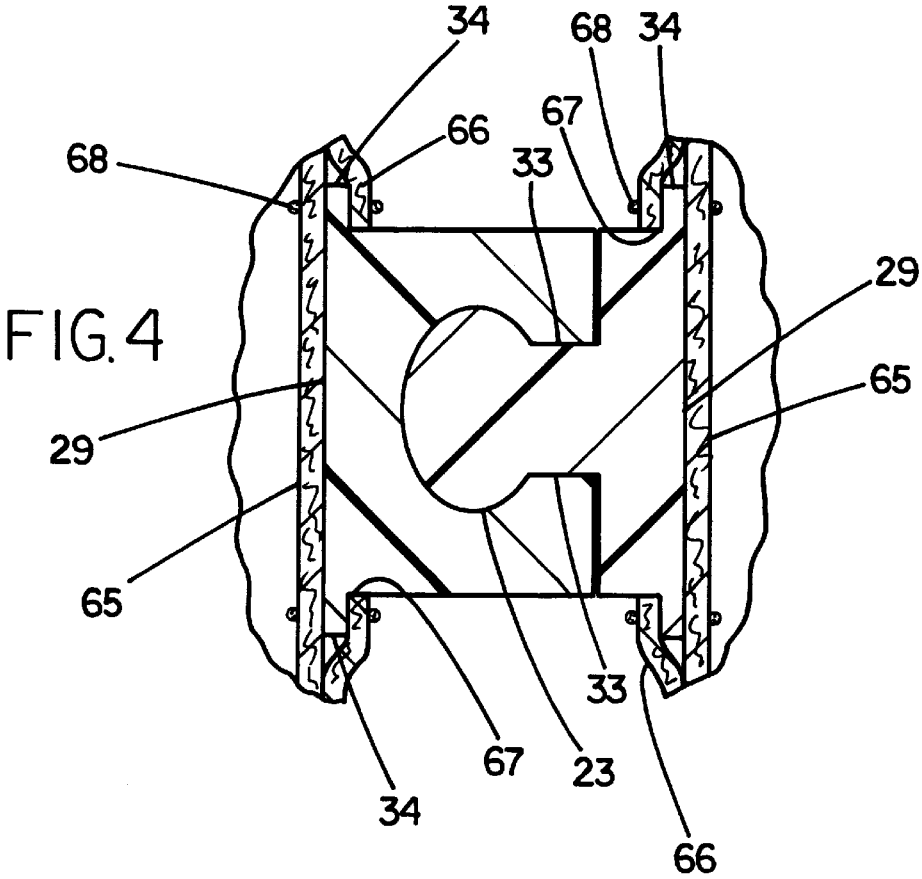
FIG. 4 is a schematic cross sectional view of the present invention.

With reference now to the drawings, and in particular to FIGS. 1 through 4 thereof, a new pair of shoes fastener embodying the principles and concepts of the present invention and generally designated by the reference numeral 10 will be described.

As best illustrated in FIGS. 1 through 4, the pair of shoes fastener 10 generally comprises a male portion 20 and a female portion 21 that are releasably coupleable together. The male portion has a neck member 22 outwardly extending from the front face thereof and a bulbous end portion 23 extending from the neck member. The female portion has an aperture 24 extending through its top and bottom faces and a pair of axial breaks 25 providing an opening through the front face of the female portion into the aperture. The aperture and the axial breaks define a groove of the female portion. The end and neck members of the male portion are slidably insertable in the groove of the female portion. The male portion is coupled to an inner side 61 of a shoe 60. The female portion is coupled to an inner side of another shoe.

Preferably, a plurality of fasteners are provided, each of the fasteners comprising a male portion and a female portion as set forth above. The male and female portions each have a generally rectangular block shape comprising generally rectangular top and bottom faces 26,(not shown), generally rectangular front and back faces 28,29, and a pair of side faces 30 extending between the front and back faces of the respective portion.

Ideally, the top and bottom faces of each portion lie in substantially parallel planes to one another. The front and back faces of each portion lie in substantially parallel planes to one another. The side face of each portion lie in substantially parallel planes to one another substantially perpendicular to the planes of the front and back faces. The planes of the front, back, and side faces extend substantially perpendicular to the planes of the top and bottom faces.

Preferably, each of the end members has a generally ovaloid transverse cross section taken perpendicular to the plane of the front face of the associated male portion. Each of the neck members has a pair of upper and lower sides 31,(not shown) lying on the planes of the top and bottom faces of the male portions. Each of the neck members has a pair of lateral sides 33 extending between its upper and lower sides. A width of each of the neck members is defined between the lateral sides of the neck member. Ideally, an outer diameter of each of the end members taken parallel the plane of the front face of the associated male portion is greater than the width of the associated neck member so that the end members of the male portions will be less likely to slip through the openings into the apertures of the female members.

Preferably, the aperture of each of the female portions has a generally ovaloid shape and an inner diameter greater than the distance between the pair of axial breaks of the associated female portion. Ideally, the distance between the pairs of axial breaks is substantially equal to the width of the neck members of the male portions.

Also preferably, each of the male and female portions has a peripheral flange 34 outwardly extending from the top, bottom, and side faces thereof. The peripheral flanges extending along the planes of the back faces of the associated portions.

A plurality of shoes 60 are provided. Each of the shoes has a toe end 63, a heel end 64, and inner and outer sides 61,62 that extend between the toe and heel ends. Inner sides of the shoes that form a pair of shoes face each other. Each of the shoes has a longitudinal axis that extends between the toe and heel ends of the shoe.

At least one portion of each of the fasteners is coupled to the inner side of each of the shoes. Complementary portions of the fasteners are coupled to opposing inner sides of the shoes. Ideally, two portions of each of the fasteners are coupled to the inner side of each of the shoes. One of the portions is positioned towards the toe end of the shoe. Another of the portions is positioned towards the heel end of the shoe.

Optionally, more than two shoes may all be coupled together using the fasteners. To permit this, at least one portion of each of the fasteners is coupled to the outer side of each of the shoes. Complementary portions of the fasteners are coupled to opposing outer sides of the shoes.

Ideally, two portions of each of the fasteners are coupled to the outer side of each of the shoes.

Preferably, the end and neck members of the male portions and the channels of the female portions are of complementary cooperating transverse cross section preventing separation of the portions without relative sliding motion between the portions of the fasteners. Ideally, in such an embodiment, the portions of the fasteners are oriented such that the sliding motion of the portions of the fasteners is in a direction generally perpendicular to longitudinal axes of the shoes.

Preferably, each of the inner and outer sides of the shoes has an inner layer 65 and an outer layer 66. Each of the outer layers of the inner sides has at least one aperture 67 extending through it, depending on how many portions of the fastener are coupled to the inner side of the associated shoe. Each of the outer layers of the outer sides may also have at least one aperture extending though it, depending on how many portions of the fastener, if any, are coupled to the outer side of the associated shoe.

Each of the portions of the fastener positioned towards the inner and outer sides of the shoes extend through the apertures of the inner and outer sides. In an embodiment where the male and female portions have peripheral flanges, the peripheral flanges of the male and female portions abutting the outer layers of the inner and outer sides of the shoes adjacent the apertures of the outer layers. Ideally, the peripheral flanges are sewed to the inner and outer layers by a strong thread 68 or similar material.

A length of each of the portions is defined between its side faces. The preferred length of each of the portions is between about ¾ and 1¼ inch, ideally about 1 inch. These dimensions were selected to maximize the amount of surface area of the portions that contact each other.

A height of each of the portions is defined between its top and bottom faces. The preferred height of each of the portions is between about ⅛ and 1 inch, ideally about ¼ inch. These dimensions were selected so that the sides of the shoes can still flex around the foot.

A width of each of the portions is defined between its front and back faces thereof. The preferred width of each of the portions is between about ¼ and ¾ inch, ideally about ½ inch. These dimensions were selected to so that the portions do not strike each other as a user walks.

In use, the shoes are placed adjacent each other, as shown in FIG. 1. One of the shoes is lifted slightly and the portions of the fasteners are slid vertically together such that the neck and end members of the male portions slide into the grooves of the female portions. The shoes are held together until one of the shoes is moved vertically with respect to the other shoe to detach the male and female portions.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A fastener for releasably coupling at least one pair of shoes together, each of the shoes having a toe end, a heel end, and inner and outer sides extending between the toe and heel ends, inner sides of the pair of shoes facing each other, said fastener comprising:

a male portion and a female portion being releasably coupleable together;

said male and female portions each having a generally rectangular block shape comprising top and bottom faces, front and back faces, and a pair of side faces extending between said front and back faces of the respective portion;

said male portion having a neck member outwardly extending from said front face thereof and a bulbous end portion extending from said neck member;

said neck member having a pair of lateral sides extending between upper and lower sides thereof, a width of said neck member being defined between said lateral sides of said neck member;

wherein an outer diameter of said end member taken parallel said plane of said front face of said male portion is greater than said width of said neck member;

said female portion having an aperture extending through said top and bottom faces thereof and a pair of axial breaks providing an opening through said front face of said female portion into said aperture;

said aperture and said axial breaks defining a groove of said female portion, said end and neck members of said male portion being slidably insertable in said groove of said female portion; and said male portion being coupled to an inner side of a shoe, said female portion being coupled to an inner side of another shoe;

wherein said end and neck member of said male portion and said aperture of said female portion have complementary cooperating transverse cross sectional shapes for resisting separation of said portions without relative sliding motion between said portions of said fasteners.

2. The fastener of claim 1, wherein said top and bottom faces of each portion lie in substantially parallel planes to one another, said front and back faces of each portion lying in substantially parallel planes to one another, said side face of each portion lying in substantially parallel planes to one another substantially perpendicular to said planes of said front and back faces.

3. The fastener of claim 1, wherein said end member has a generally ovaloid transverse cross section taken perpendicular to said plane of said front face of said male portion, said female portion having a generally ovaloid aperture extending through said top and bottom faces thereof and a pair of axial breaks providing an opening through said front face of said female portion into said aperture.

4. The fastener of claim 1, wherein each of said portions has a peripheral flange outwardly extending from said top, bottom, and side faces thereof, said peripheral flange extending along a plane extending across said back faces of the associated portion, each of said portions extending through an aperture of an outer layer of each of said shoes, said peripheral flanges of said male and female portions abutting said outer layers of said shoes adjacent said apertures of said outer layers.

5. The fastener of claim 4, wherein said peripheral flanges are sewed to an inner and said outer layers of said shoes.

6. The fastener of claim 1, further comprising a plurality of male and female portions, wherein two portions are coupled to said inner side of one of said shoes, one of said portions being positioned towards a toe end of said shoe, another of said portions being positioned towards a heel end of said shoe, complementary portions being coupled to said inner side of another said shoe.

7. The fastener of claim 1, further comprising a plurality of male and female portions, at least one portion being coupled to said outer side of one of said shoes, a complementary portion being coupled to opposing outer sides of another said shoe.

8. The fastener of claim 7, wherein two portions are coupled to said outer side of each of said shoes.

9. The fastener of claim 1, wherein said portions of said fasteners are oriented such that said sliding motion of said portions of said fasteners is in a direction generally perpendicular to longitudinal axes of said shoes.

10. The fastener of claim 1, wherein a length of each of said portions is defined between said side faces thereof, wherein said length of each of said portions is between about ¾ and 1¼ inch, ideally about 1 inch.

11. The fastener of claim 1, wherein a height of each of said portions is defined between said top and bottom faces thereof, wherein said height of each of said portions is between about ⅛ and 1 inch, ideally about ¼ inch.

12. The fastener of claim 1, wherein a width of each of said portions being defined between said front and back faces thereof, wherein said width of each of said portions is between about ¼ and ¾ inch, ideally about ½ inch.

13. A fastening system for releasably coupling at least one pair of shoes together, said fastening system comprising:

a plurality of fasteners, each of said fasteners comprising a male portion and a female portion being releasably coupleable together;

said male and female portions each having a generally rectangular block shape comprising generally rectangular top and bottom faces, generally rectangular front and back faces, and a pair of side faces extending between said front and back faces of the respective portion;

said top and bottom faces of each portion lying in substantially parallel planes to one another;

said front and back faces of each portion lying in substantially parallel planes to one another;

said side face of each portion lying in substantially parallel planes to one another substantially perpendicular to said planes of said front and back faces;

said planes of said front, back, and side faces being extended substantially perpendicular to said planes of said top and bottom faces;

each of said male portions having a neck member outwardly extending from said front face thereof and a bulbous end portion extending from said neck member;

each of said end members having a generally ovaloid transverse cross section taken perpendicular to said plane of said front face of the associated male portion;

each of said neck member having a pair of upper and lower sides lying on said planes of said top and bottom faces of said male portions;

each of said neck members having a pair of lateral sides extending between said upper and lower sides thereof, a width of each of said neck members being defined between said lateral sides of said neck member;

wherein an outer diameter of each of said end members taken parallel said plane of said front face of the associated male portion is greater than said width of the associated neck member;

each of said female portions having a generally ovaloid aperture extending through said top and bottom faces thereof and a pair of axial breaks providing an opening through said front face of the associated female portion into said aperture;

said apertures and said axial breaks defining grooves of said female portions, said end and neck members of said male portions being slidably insertable in said grooves of said female portions;

each of said portions having a peripheral flange outwardly extending from said top, bottom, and side faces thereof, said peripheral flanges extending along said planes of said back faces of the associated portions;

a plurality of shoes, each of said shoes having a toe end, a heel end, and inner and outer sides extending between said toe and heel ends, inner sides of shoes forming a pair of shoes facing each other, each of said shoes having a longitudinal axis extending between said toe and heel ends of said shoe;

at least one portion of each of said fasteners being coupled to said inner side of each of said shoes, complementary portions of said fasteners being coupled to opposing inner sides of said shoes;

wherein two portions of each of said fasteners are coupled to said inner side of each of said shoes, one of said portions being positioned towards said toe end of said shoe, another of said portions being positioned towards said heel end of said shoe;

at least one portion of each of said fasteners being coupled to said outer side of each of said shoes, complementary portions of said fasteners being coupled to opposing outer sides of said shoes;

wherein two portions of each of said fasteners are coupled to said outer side of each of said shoes;

wherein said end and neck members of said male portions and said channels of said female portions are of complementary cooperating transverse cross section preventing separation of said portions without relative sliding motion between said portions of said fasteners;

wherein said portions of said fasteners are oriented such that said sliding motion of said portions of said fasteners is in a direction generally perpendicular to longitudinal axes of said shoes;

each of said inner sides of said shoes having an inner layer and an outer layer, each of said outer layers of said inner sides having at least one aperture extending therethrough;

each of said portions of said fastener positioned towards said inner sides of said shoes extending through said apertures of said inner sides;

said peripheral flanges of said male and female portions abutting said outer layers of said inner sides of said shoes adjacent said apertures of said outer layers;

wherein said peripheral flanges are sewed to said inner and outer layers of said inner sides of said shoes;

each of said outer layers of said outer sides having at least one aperture extending therethrough;

each of said portions of said fastener positioned towards said outer sides of said shoes extending through said apertures of said outer sides;

said peripheral flanges of said male and female portions abutting said outer layers of said outer sides of said shoes adjacent said apertures of said outer layers;

wherein said peripheral flanges are sewed to said inner and outer layers of said outer sides of said shoes;

a length of each of said portions being defined between said side faces thereof, wherein said length of each of said portions is between about ¾ and 1¼ inch, ideally about 1 inch;

a height of each of said portions being defined between said top and bottom faces thereof, wherein said height of each of said portions is between about ⅛ and 1 inch, ideally about ¼ inch; and a width of each of said portions being defined between said front and back faces thereof, wherein said width of each of said portions is between about ¼ and ¾ inch, ideally about ½ inch.

* * * * *